United States Patent [19]

Cargnino et al.

[11] Patent Number: 4,741,847

[45] Date of Patent: May 3, 1988

[54] AQUEOUS ANTI-CORROSION AGENT CONTAINING AN AMMONIUM SALT OF 2-BENZTHIAZOLYTHIOCARBOXYLIC ACID

[75] Inventors: Francesco Cargnino, Venaria; Giuseppe Natoli, Turin, both of Italy; Horst Lorke, Liederbach, Fed. Rep. of Germany

[73] Assignee: Hoechst Aktiengesellschaft, Frankfurt am Main, Fed. Rep. of Germany

[21] Appl. No.: 830,370

[22] Filed: Feb. 18, 1986

[30] Foreign Application Priority Data

Feb. 19, 1985 [IT] Italy ..... 19562 A/85

[51] Int. Cl.[4] ..... C10M 133/38; C10M 135/36

[52] U.S. Cl. ..... 252/47.5; 252/49.3; 252/49.5; 252/34; 544/287; 544/288

[58] Field of Search ..... 252/47.5, 49.3; 544/287, 288

[56] References Cited

U.S. PATENT DOCUMENTS

| | | | |
|---|---|---|---|
| 2,154,097 | 4/1939 | Loane | 252/47.5 |
| 2,425,426 | 8/1947 | Joyce, Jr. | 252/47.5 |
| 3,080,314 | 3/1963 | Ayers | 252/47.5 |
| 3,166,563 | 1/1965 | Epstein et al. | 252/47.5 |
| 3,215,641 | 11/1965 | Rocklin | 252/47.5 |
| 3,536,706 | 10/1970 | Randell | 252/47.5 |
| 3,537,999 | 11/1970 | Kennedy | 252/47.5 |
| 3,663,559 | 5/1972 | Derijckene et al. | 252/47.5 |
| 4,113,637 | 9/1978 | Cohen et al. | 544/287 |
| 4,177,155 | 12/1979 | Popplewell | 252/49.3 |
| 4,367,152 | 1/1983 | Wright et al. | 252/47.5 |

FOREIGN PATENT DOCUMENTS

| | | | |
|---|---|---|---|
| 258098 | 11/1960 | Netherlands | 252/47.5 |

*Primary Examiner*—William R. Dixon, Jr.
*Assistant Examiner*—Ellen McAvoy

[57] ABSTRACT

The use of 2-benzthiazolylthiocarboxylic acid ammonium salts of the formula

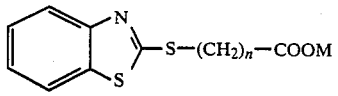

wherein n denotes a number from 1 to 6 and M denotes an organic ammonium ion as a corrosion-inhibiting agent in aqueous functional fluids, in particular in aqueous cooling lubricants.

4 Claims, No Drawings

AQUEOUS ANTI-CORROSION AGENT CONTAINING AN AMMONIUM SALT OF 2-BENZTHIAZOLYTHIOCARBOXYLIC ACID

When metals are machined, for example bored, turned, milled and subjected to similar processes, use is often made of so-called cooling lubricants in the form of aqueous emulsions of mineral oils. Wholly aqueous cooling lubricants containing no oils are, however, being used for this purpose to an increasing extent. These are essentially combinations of salts of organic acids with water-soluble polyadducts obtained by an addition reaction between ethylene oxide, propylene oxide and/or butylene oxide and compounds containing active hydrogen atoms.

When aqueous mineral oil emulsions are used as liquid coolants, it is a disadvantage that these emulsions break readily, which is due especially to the effects of heat, to an alteration in the pH or to a change in the electrolyte charge. Consequently, an alteration in these parameters will have a harmful effect on the quality of the emulsions, so that after a certain time the emulsion is no longer serviceable. A further disadvantage of mineral oil emulsions is that their milky appearance makes it more difficult to observe the progress of machining.

In order to avoid these disadvantages, the use of water-soluble compounds has acquired increasing importance in the machining of metals. Compared with the oil emulsions, these aqueous solutions have the advantage of greater stability, they are less subject to attack by bacteria, they are insensitive to the nature of the water used and, compared with the customary oils, they possess a better lubricity.

The main problem in all these fluids is an effective antirust action, which hitherto has generally been achieved by using sodium nitrite. However, this compound leaves a crystalline residue on the surfaces treated with it, can damage, under certain circumstances, parts of the precision machines used, and decomposes at high temperatures with the formation of nitrous vapors, which are harmful for the operators. In addition, nitrite is also harmful for the environment, since not more than 0.6 ppm is permissible in effluents. Attempts have, therefore, been made to fine additives which, on the one hand, exhibit optimum anticorrosion properties, and, on the other hand, are intended to avoid the problems mentioned above.

German Auslegeschrift No. 1,149,843 describes additives for motor fuels and lubricating oils, which contain, as the antirust agent, salts of primary, aliphatic amines of certain amino acids. German Auslegeschrift No. 2,922,562 discloses, as antirust agents in aqueous systems, amine salts of dicarboxylic acid, 0.3% to 50% of these antirust agents being present in the lubricants. The use of 2-mercaptobenztriazole as an anticorrosion agent for copper is also known. In addition, the use of benzthiazolylmercaptodicarboxylic acid as corrosion inhibitors is also known (European Pat. No. 0,129,506).

It is known, moreover, that all anticorrosion agents used as antirust agents in aqueous systems for machining metals only have a good anticorrosion power at fairly high pH values, in general between 8–8.5 and 9. In addition, they do not exert anticorrosion action on copper. It is also known that many of these additives tend to flocculate and to form foam with calcium salts, which restricts their use further.

The object of the present invention is to find new compounds which have an anticorrosion action, which have no harmful effects on the operators or on the environment and which can be used, not only with ferrous metals, but also with copper and aluminum.

Surprisingly, this object is achieved in accordance with the invention by means of ammonium salts of 2-benzthiazolylthiocarboxylic acid, which meet all the requirements set and, unexpectedly, permit use at pH values in the neighborhood of the neutral point (7–7.5). Since these compounds do not at all lead to flocculation or form foam with calcium salts, they can be used with water of any kind without impairment of their antirust power.

The invention therefore relates to aqueous anticorrosion agents containing an ammonium salt of 2-benzthiazolylthiocarboxylic acid of the formula

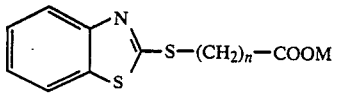

wherein n denotes a number from 1 to 6 and M denotes an organic ammonium ion.

These 2-benzthiazolylthiocarboxylic acids are prepared by reacting 2-mercaptobenzthiazole with ω-halogenocarboxylic acids. Instead of free mercaptobenzthiazole and free halogenocarboxylic acid, it is also possible to use the alkali metal salts thereof.

The molar ratio of the two starting compounds is approx. 1:1. In general the reaction is carried out at a temperature of 30° to 80° C. and for a period of 1 to 4 hours. When the reaction is complete, the mixture is acidified and the resulting free acid is separated off, purified and dried. The ammonium salts indicated above are prepared by then dissolving this free acid in an aqueous solution of the desired amine corresponding to the meaning of the symbol M. This solution can then be used without further treatment, but is preferably diluted further with water.

Suitable ammonium ions under the designation M are any ammonium ions derived from organic amines, in particular organic ammonium ions which, together with the anion of the benzthiazolylcarboxylic acid, form salts soluble or emulsifiable in water. Ions which should be mentioned especially in this connection are the ammonium ions derived from monomethylamine, dimethylamine and trimethylamine, monoethylamine, diethylamine and triethylamine, monoisopropylamine, monobutylamine and dibutylamine, 3-methoxypropylamine, trimethylpentylamine, monoethanolamine, diethanolamine and triethanolamine, and monoisopropanolamine, diisopropanolamine and triisopropanolamine. For economic reasons and because of their better action, salts with monoethanolamine, diethanolamine and triethanolamine are preferred.

The resulting aqueous solutions of the salts of 2-benzthiazolylthiocarboxylic acids are clear and undergo no change even on being left to stand for 24 hours. No foam is formed, and the solutions exhibit an excellent corrosion resistance with ferrous metals, copper and aluminum. Fairly highly concentrated solutions having a content of active substance of approx. 20 to 50% are initially prepared for the use of the 2-benzthiazolylthiocarboxylic acid salts, as is generally customary in the field of metal machining agents. When used, these commercial forms are then diluted further, and the finished solution for use contains approx. 0.3 to 5% by weight of active substance.

The aqueous solutions of ammonium salts of 2-benzthiazolylthiocarboxylic acids are very generally suitable for use as anticorrosion agents with ferrous metals, copper and aluminium, in particular in the case of coolant circuits, hydraulic fluids and, preferably, aqueous cooling lubricants for metal working. In addition to the anti-corrosion agent described, all these functional fluids also contain the customary active substances required for the particular purpose. The particular composition of these functional fluids in an individual case is adequately known to those skilled in the art and does not require more detailed explanation here.

EXAMPLE 1

167 g (1 mol) of mercaptobenzthiazol are dissolved in water by means of sodium hydroxide, and the solution is diluted with 500 g of methanol. An aqueous solution of 1.2 mol of sodium monochloroacetate is added slowly at 30°–70° C. to this mixture.

The reaction is continued for a further 2 hours within the temperature range between 40° and 50° C. The water/methanol ratio is 1:1.

The solution is then acidified with hydrochloric acid or acetic acid until a pH between 1 and 3 is reached This gives 2-benzthiazolylthioacetic acid in the form of a white powder which is purified from the inorganic salts and from unreacted reaction products and is dried: melting point 155°–158° C.

EXAMPLE 2

1 mol of sodium monochloroacetate is added, at a temperature of 40° C., to an aqueous solution containing 1 mol of the sodium salt of mercaptobenzothiazole, and the mixture is then allowed to react for a further hour at the same temperature. The solution is then acidified to pH 5.0–6.0 with hydrochloric acid. At this point the reaction solution is filtered, in order to remove impurities. Further hydrochloric acid is added to the solution thus purified, until a pH of 1 to 3 has been reached. 2-benzthiazolylthioacetic acid is obtained in the form of a white powder having a melting point of 155°–156° C.

EXAMPLE 3

An aqueous solution of 1.2 mol of sodium monochloropropionate is added slowly, at a temperature of 50° C., to an aqueous solution containing 1 mol of the sodium salt of mercaptobenzthiazol.

The reaction is continued at a temperature of 60°–70° C. for 2 hours, and the mixture is then acidified with hydrochloric acid until no further precipitate is formed.

2-Benzthiazolylthiopropionic acid is obtained in the form of a white powder which, after purification and drying, has a melting point of 145°–147° C.

Some essential characteristic data of the triethanolamine salt of 2-benzthiazolylthioacetic acid are given in the table which follows. The testing of corrosion resistance was carried out as specified in DIN Standard 51,360 (I and II). The abbreviations have the following meanings:

EK = 2-benzthiazolylthioacetic acid
TEA = triethanolamine
RO = no rust
SO = no pitting

| CHARACTERISTIC VALUES of the free acid (Product EK) | | Formulations |
|---|---|---|
| 1. Appearance: white powder | | 29% of product EK |
| 2. Acid number: 245 | | 56% of technical TEA |
| | | 15% of distilled $H_2O$ |
| 1. Appearance at 20° C. | | yellow-brown, clear |
| 2. 3% strength solution ($H_2O$ of 20 degrees of German hardness) | | |
| (a) Appearance | immediately | clear |
| (b) Appearance | after 24 hours | clear |
| (c) pH | | 8.2 |
| (d) Foaming behavior ULTRA-TURRAX 500 ml of 1.5% strength solution in $H_2O$ of 20 degrees German hardness in a 1000 ml cylinder, stirred for 1 minute (1000 r.p.m.) | immediately | 620 ml |
| | after 1 minute | 550 ml |
| | after 2 minutes | 500 ml |
| | after 3 minutes | |
| | after 5 minutes | |
| 3. Test of corrosion resistance at 0.5% strength | | RO/SO |
| (a) Herbert test untreated $H_2O$ of 20 degrees German hardness | 1% | RO/SO |
| DIN 51,360, sheet I | 5% | RO/SO |
| (b) Filter paper test | 1.5% | 1 |
| DIN 51,360, sheet II | 2.0% | 0 |
| | 2.5% | 0 |
| | 3.0% | 0 |
| (c) Copper strip test Assessed after 20 days/20° C. | 1.5% | slight blue coloration in the solution (TEA has strong blue coloration) |
| (d) Aluminum strip test assessed after 20 days/20° C. | 1% | Aluminum surface unchanged |
| 4. Microbiology | | |
| Preservation loading test | 1.5% | No preservation |
| Against bacteria | 3.0% | Adequate |

In the test below, the anticorrosion agents C and D according to the invention were compared with two already known anticorrosion agents A and B.

The comparison substances used were the salts of two known acids, isononanoic acid and p-tert.-butylbenzoic acid. The appropriate solutions had the following composition:

(A) 22% by weight of isononanoic acid
63% by weight of triethanolamine
15% by weight of water (B) 25% by weight of p-tert.-butylbenzoic acid
60% by weight of triethanolamine
15% by weight of water (C) 31.5% by weight of the compound according to Example 1 or 2 of the present invention
53.5% by weight of triethanolamine
15% by weight of water (D) 33% by weight of the compound according to Example 3 of the present invention
52% by weight of triethanolamine
15% by weight of water The results are collated in the following table:

| | A | B | C | D |
|---|---|---|---|---|
| Solubility 3% strength aqueous solution in distilled $H_2O$ | | | | |
| (a) after making up | clear | clear | clear | clear |
| (b) after 24 hours | clear | clear | clear | clear |
| in tap water of 20° German hardness | | | | |
| (a) after making up | clear | clear | clear | clear |
| (b) after 24 hours | cloudy sediment | crystal-line sediment | clear | clear |
| Foaming behavior | | | | |
| DIN 53,902 | slowly collaps-ing foam | slowly collaps-ing foam | no foam | no foam |
| Corrosion resistance DIN 51,360 I | | | | |
| 0.3% strength solution in water of 20° German hardness (tap water) | marked rusting | marked rusting | no rust | no rust |
| 0.5% strength solution in water of 20° German hardness (tap water) | marked rusting | trace of rust | no rust | no rust |
| DIN 51,360/II | | | | |
| 1.5% strength solution in water of 20° German hardness (syn-thetic water) | marked rusting | marked rusting | no rust | no rust |
| 2% strength solution in water of 20° German hardness (syn-thetic water) | marked rusting | marked rusting | no rust | no rust |
| Copper strip test 1.5% strength solution | strong blue coloration | | colorless solution | |
| Aluminum strip test 1.5% strength solution | white coating on the test strips | | test strips unchanged | |

The corrosion test on copper and aluminum was carried out as follows. 1.5 g of the mixtures A, B, C and D are added to each of four test tubes containing 100 cc of water, and copper foils or aluminum foils as specified in DIN 1791-E-CU 57 F30 of dimensions 2×12×75 mm are immersed in these solutions. The test tubes are closed and kept at 20° C. for 20 days. At the end of the test the color assumed by the solution is observed:

| For copper: | For aluminum: |
|---|---|
| A: strong bluish coloration | white coating on the test strips |
| B: strong bluish coloration | white coating on the test strips |
| C: colorless solution | test strips unchanged |
| D: colorless solution | test strips unchanged. |

What is claimed is:

1. An aqueous anticorrosion agent containing a compound of the formula

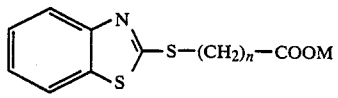

wherein n denotes a number from 1 to 6 and M denotes an organic ammonium ion.

2. An aqueous anticorrosion agent as claimed in claim 1, wherein said compound is present in an amount ranging from 0.3 to 5% by weight.

3. An aqueous cooling lubricant containing a compound of the formula

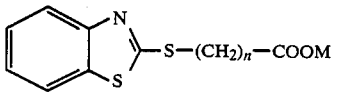

wherein n denotes a number from 1 to 6 and M denotes an organic ammonium ion.

4. An aqueous cooling lubricant as claimed in claim 3, wherein said compound is present in an amount ranging from 0.3 to 5% by weight.

* * * * *